US006173866B1

(12) United States Patent
Taylor, Jr. et al.

(10) Patent No.: US 6,173,866 B1
(45) Date of Patent: Jan. 16, 2001

(54) WRIST-CARRIED WATER CONTAINER APPARATUS

(76) Inventors: Lucian Taylor, Jr.; Lachele M. Taylor, both of 1332 Beulah Park, Lexington, KY (US) 40517

( * ) Notice: Under 35 U.S.C. 154(b), the term of this patent shall be extended for 0 days.

(21) Appl. No.: 09/506,762

(22) Filed: Feb. 18, 2000

(51) Int. Cl.[7] ..... B67D 5/64
(52) U.S. Cl. ..... 222/175; 222/529; 222/530
(58) Field of Search ..... 222/175, 528, 222/529, 530

(56) References Cited

U.S. PATENT DOCUMENTS

D. 315,245 * 3/1991 Envall ..... D3/100
D. 323,430 * 1/1992 Niederkorn ..... D3/100
D. 373,240 * 9/1996 Parnell ..... D3/202
4,736,876 * 4/1988 Kriss ..... 222/175
4,890,767 * 1/1990 Burlison ..... 222/78
5,566,869 * 10/1996 Katz ..... 224/148.6
5,571,260 * 11/1996 Krug ..... 222/175
5,669,529 * 9/1997 Levit ..... 222/175

* cited by examiner

*Primary Examiner*—Philippe Derakshani
(74) *Attorney, Agent, or Firm*—Carrithers Law Office; David W. Carrithers

(57) ABSTRACT

A removable wrist strap having a compartment containing a potable liquid held to the user's wrist by a VELCRO fastener. The wrist strap includes a tube or spout for the user to access the liquid during physical activity.

8 Claims, 8 Drawing Sheets

FIG 5
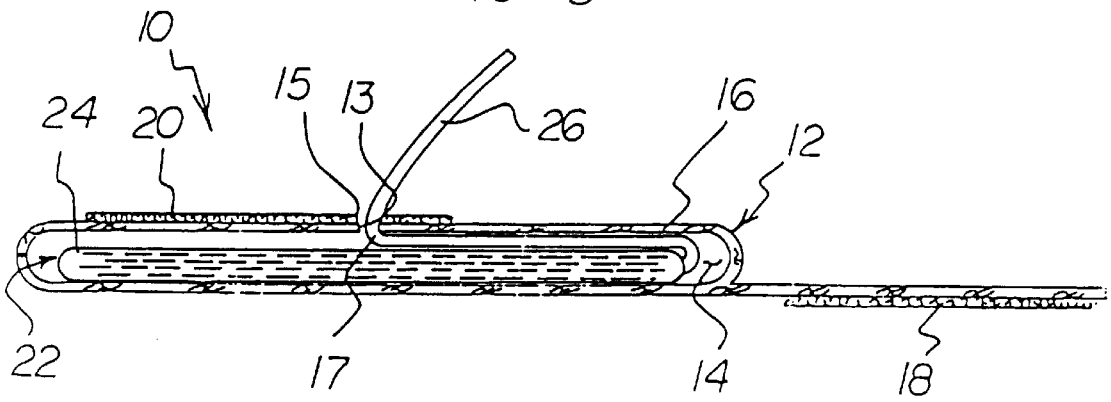
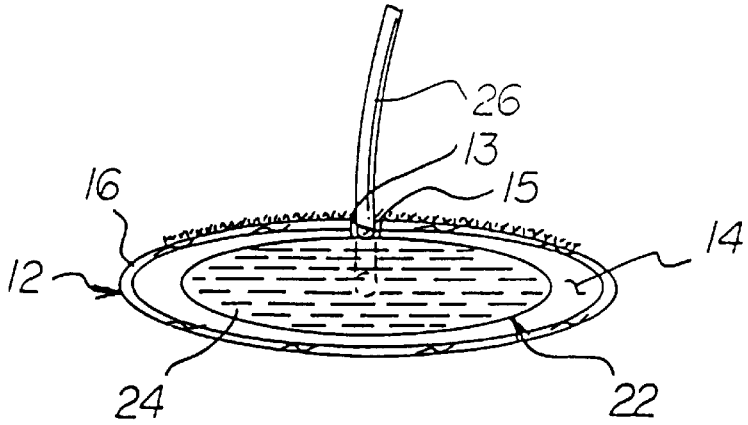
FIG 6

WRIST-CARRIED WATER CONTAINER APPARATUS

BACKGROUND OF THE INVENTION

Athletes and other individuals who compete or who are required to complete rigorous physical activities within a short specified time frame such as for military training are often required to complete exercises requiring running or walking. Sources of water or other potable liquids are often not available and the user may not want to lose precious time by leaving the local or stopping for a drink. Conventional storage containers are too bulky to wear or carry. Portable storage containers known in the art utilize a water reservoir and method of holding to the user such as an elastic strip of VELCRO attached headband, wristband or the like. However, none of the known containers utilize a container having a replaceable and disposable reservoir of liquid therein attachable to the arm of the user.

SUMMARY OF THE INVENTION

The present invention relates to a removable wrist strap having a compartment containing a disposable and/or replaceable reservoir of potable liquid held to the user's wrist by a VELCRO fastener. The wrist strap includes a spout for the user to access the liquid during physical activity.

The wrist-carried water container apparatus of the present invention features a liquid container apparatus including a flexible jacket assembly having an interior, container portion defining a compartment, sealable pouch, or the like within an exterior jacket surface. A fist fastener element is connected to a first end of the flexible jacket assembly. A second fastener element is connected to a second end of the flexible jacket assembly. In the flexible jacket assembly, a flexible liquid tight container assembly includes a flexible container portion which is housed in the container retention space. A spout member is connected to the flexible container portion and extends out from the container retention space. The liquid container apparatus can contain water or other potable liquid in a volume of preferably from 0 to 16 oz., more preferably from 3 to 12 oz. and most preferably from 6 to 8 oz., and can be worn on a person's wrist so that the person can readily drink the contained water during physical activity such as in athletic activities or military training. The container may be compartmentalized by plastic divider walls, or separate inflatable bladders or bags to hold isolate specifics amounts of a selected liquid.

The sport member is a flexible spout tube. The flexible jacket assembly includes a jacket-wall spout channel through which the flexible spout tube extends from the flexible container portion to outside the flexible jacket assembly. In addition, the second fastener element includes a fastener spout channel which is placed in registration with the jacket-wall spout channel and through which the flexible spout tube extends from the flexible container portion to outside the flexible jacket assembly and the second fastener element. Separate tubes may be used for an embodiment utilizing a plurality of compartments or a tube manifold may be used connecting to a single exterior tube spout.

Preferably, the flexible jacket assembly and the flexible liquid-tight container assembly are dimensioned to fit around a wearer's wrist such that a wristband liquid container apparatus is provided. The first fastener element and the second fastener element are made from complementary hook and loop material such as "VELCRO™" material.

The flexible jacket may be formed of a sleeve of material having one end closed by sewing, heat welding, or the like and having an opposing open end for insertion of a reservoir. It is also contemplated that the sleeve could be closed on both ends and that the reservoir be slipped into a slit cut into the inner surface of the sleeve for disposing and removing the liquid containing reservoir. The sleeve can be formed of fabric, foam lined fabric, or elastomeric material optionally lined with foam for insulation purposes. Moreover, a porous sleeve formed having large or even micro pores may be used together or with a net to allow radiation from cold or ice packs to affect the user.

More particularly, the present invention defines a personal storage and liquid dispensing device comprising a flexible band comprising a jacket having a first end and a second end including an inner and outer layer of material joined together at the sides and on at least one end forming a container retention space thereinbetween. A flexible band includes a removable flexible container for holding liquid within said container retention space.

The flexible container includes a tube connecting thereto for removing the liquid therefrom. Means for stopping the flow of water flowing from said flexible reservoir through tube such as a crimp or spigot is included as well. The flexible band includes an opening for extending the tube therethrough. The first end of the jacket includes means for releasably holding attaching to an exterior surface thereof cooperatively engaging with said second end of said jacket including means for releasably holding attaching to an interior surface thereof defining a hook and loop fastener. Finally, the personal storage and liquid dispensing device is designed for removably circumscribing a selected limb of an individual wearer and being securely held on said selected limb during use. For instance, the limb is selected from the group consisting of an arm, a wrist, an ankle, or a leg.

The present invention also provides a means for the wearer to maintain a specific heart rate without having to stop to consume water or cool off too quickly.

The present invention can be fabricated in a variety of colors and are personal so that there is no confusion as to who's has which unit as opposed to user's on a team searching for a particular water bottle.

It is an object of the present invention to provide a convenient storage container for holding potable liquid on a person's wrist for consumption during physical activity.

It is an object of the present invention to provide a means to access the wrist storage container such as a tube, spout, or tube having a spout attached to the end so that the water can be sipped without stopping the physical activity.

It is an object of the present invention to provide as an option a spout having a distal end having a restriction or partially closed end so that fluid flow through the spout only upon suction being applied by the user.

It is an object of the present invention to provide as an option a tube having a crease section therein to provide a method for preventing the flow of water from the tube upon bending the tube at the crease for storage while not in use, and that the tube be held into place by a removable patch of material attached by hook and loop fasteners or the like.

It is another object of the present invention to provide an open end or side to removing and replacing the liquid container.

It is another object of the present invention to provide a liquid container that is composed of a flexible plastic.

It is another object of the present invention to provide a liquid container that is disposable.

It is another object of the present invention to provide a method of controlling the amount of water consumed by the user.

It is another object of the present invention to hold gelatin or other semisolid food substrate.

It is another object of the present invention to include bright reflector strips on the exterior surface for providing a nighttime reflector.

It is another object of the present invention to provide container for holding water for freezing into ice packs to be worn by the user.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 5 is a cross-sectional view of the embodiment of the invention shown in FIG. 4 taken along line 5—5 of FIG. 4;

FIG. 6 is a cross-sectional view of the embodiment of the invention shown in FIG. 4 taken along line 6—6 of FIG. 4.

DESCRIPTION OF THE PREFERRED EMBODIMENT

Figure 1:
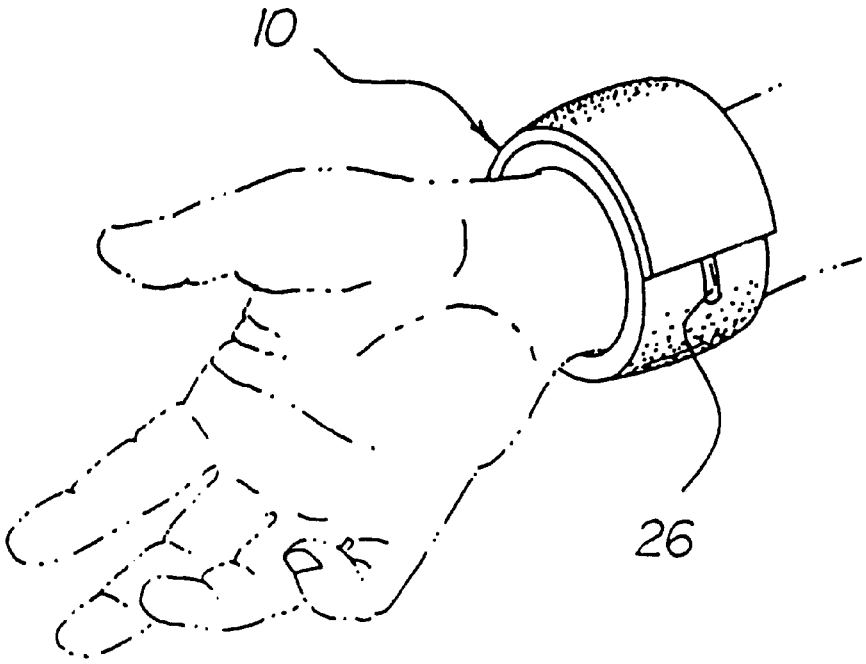
FIG. 1 is a perspective view showing a preferred embodiment of the wrist-carried water container apparatus of the invention attached to a wearer's wrist.
Figure 2:
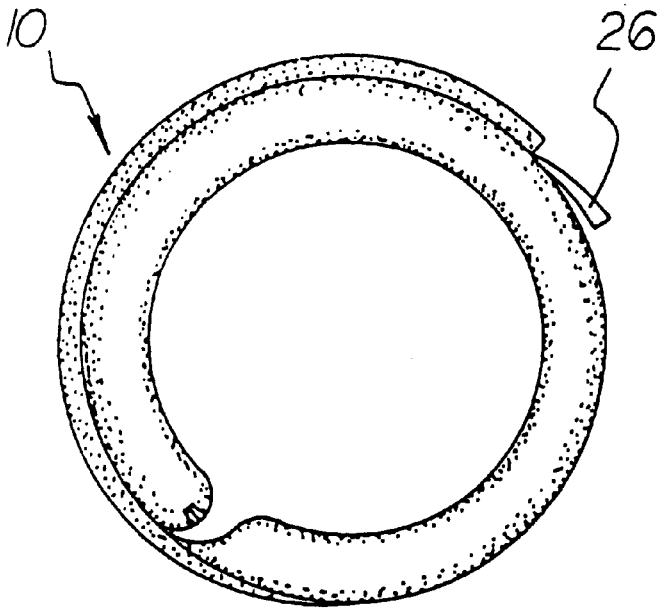
FIG. 2 is an enlarged front end view of the embodiment of the wrist carried water container apparatus shown in FIG. 1 removed from the wearer's wrist.
Figure 3:
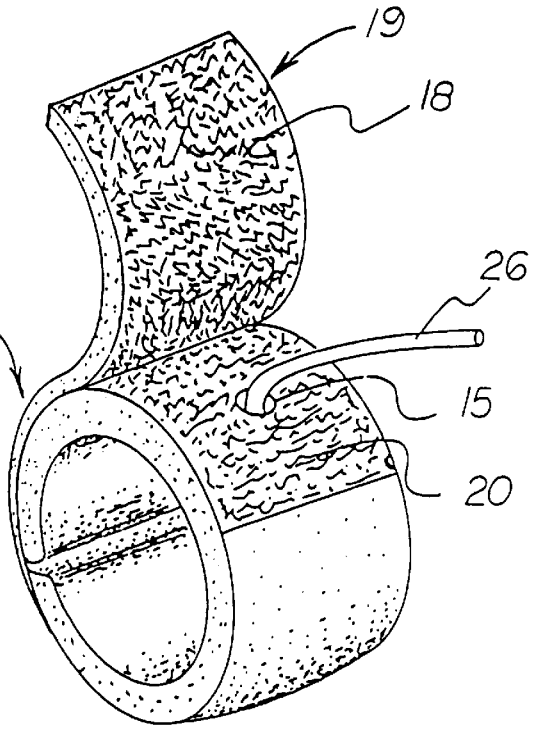
FIG. 3 is a perspective view of the embodiment of the wrist carried water container apparatus of FIG. 2 in the process of being unfastened from a wrist encompassing status.

With reference to the drawings, a new and improved liquid container apparatus embodying the principles and concepts of the present invention will be described.

Turning to FIGS. 1–9, there is shown an exemplary embodiment of the liquid container apparatus of the invention in the form of a wrist-carried water container apparatus of the invention generally designated by reference numeral 10. In its preferred form, the wrist-carried water container apparatus 10 includes a flexible jacket assembly 12 which includes an interior, container-retention space 14 and an exterior jacket surface 16. A first fastener element 18 forming a cover flap 19 is connected to an interior surface of a first end of the flexible jacket assembly 12. The first fastener element 18 may also be applied to one or more straps extending from the distal end of the jacket assembly 12. A second fastener element 20 is connected to an exterior surface of a second end of the flexible jacket assembly 12. In the flexible jacket assembly 12, a flexible liquid-tight container assembly 22 includes a flexible container portion 24 which is housed in the container-retention space 14. A tube defining a spout member is connected to the flexible container portion 24 and extends out from the container-retention space 14. The liquid stored in the flexible container portion 24 can be water or any suitable liquid or flowable material.

The spout member is a flexible spout tube 26. The flexible jacket assembly 12 includes a jacket-wall spout channel 13 through which the flexible spout tube 26 extends from the flexible container portion 24 to outside the flexible jacket assembly 12. In addition, the second fastener element 20 includes an opening defining a fastener spout channel 15 which is placed in registration with the jacket-wall spout channel 13 and through which the flexible spout tube 26 extends from the flexible container portion 24 to outside the flexible jacket assembly 12 and the second fastener element 20. The jacket-wall spout channel 13 and the fastener tube spout channel 15 are alignable and medially located with respect to the second fastener element 20.

Figure 11:
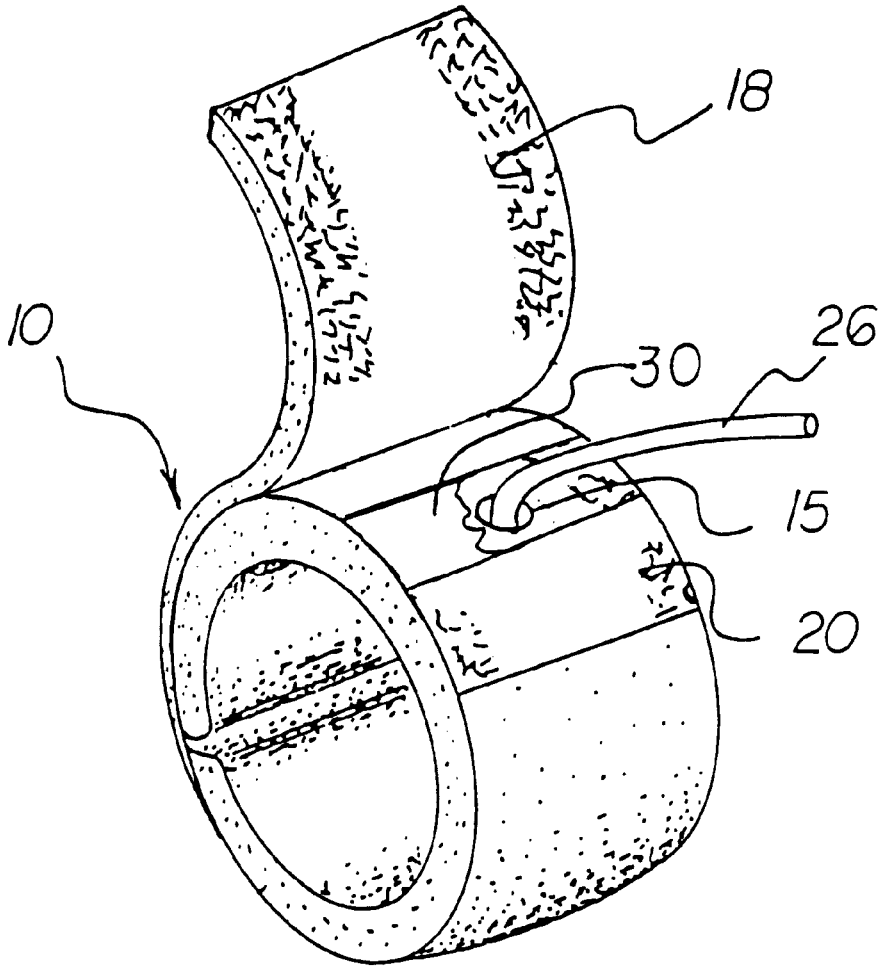
FIG. 11 is a perspective cutaway view of an embodiment of the wrist carried water container apparatus in the process of being unfastened from a wrist encompassing status showing a pair of hook and loop fastening straps extending from the distal end of the wrist strap and a separate removable flap covering the tube.
Figure 12:
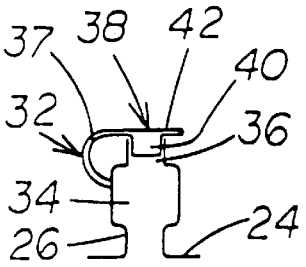
FIG. 12 is a side view of a collapsible spigot in the extended state extending from the distal end of a tube extending from the flexible container including a removable stopper inserted therein.
Figure 13:
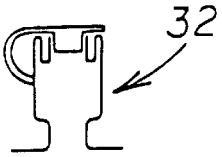
FIG. 13 is a side view of a collapsible spigot in the collapsed state extending from the distal end of the tube extending from the flexible container including a flexible stopper inserted therein.
Figure 14:
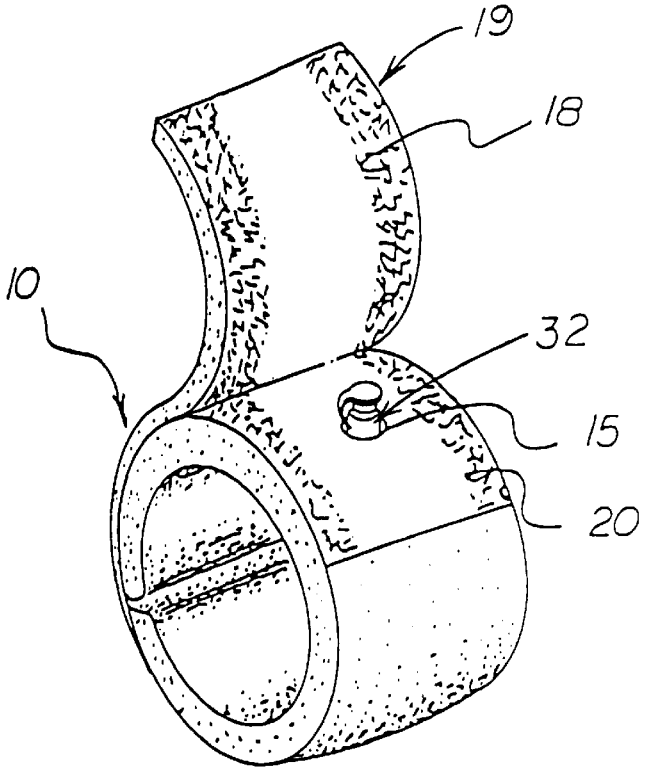
FIG. 14 is a perspective view showing a preferred embodiment of the wrist-carried water container apparatus wherein the collapsible spigot having a stopper therein extends outwardly past the jacket wall exposed by detaching a portion of the hook and loop fastener retained strap of material.
Figure 15:
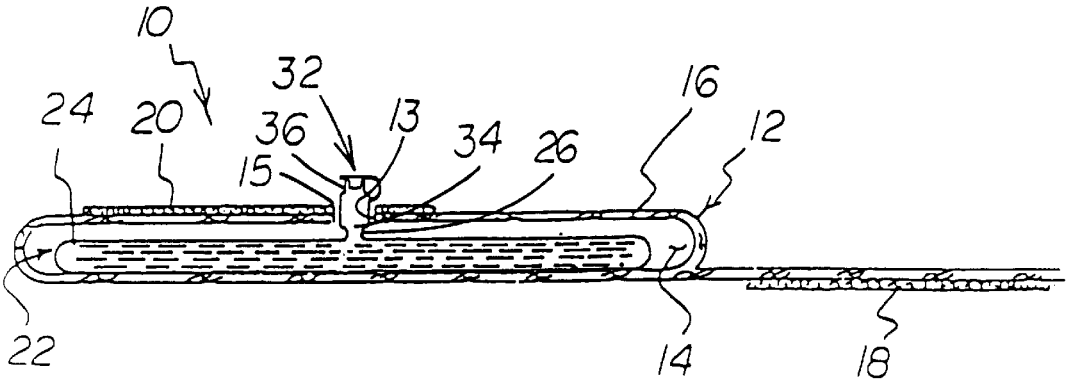
FIG. 15 is a side view showing a collapsible spigot in the extended view extending from the flexible container through an opening in the exterior jacket surface and through the second fastener element.
Figure 16:
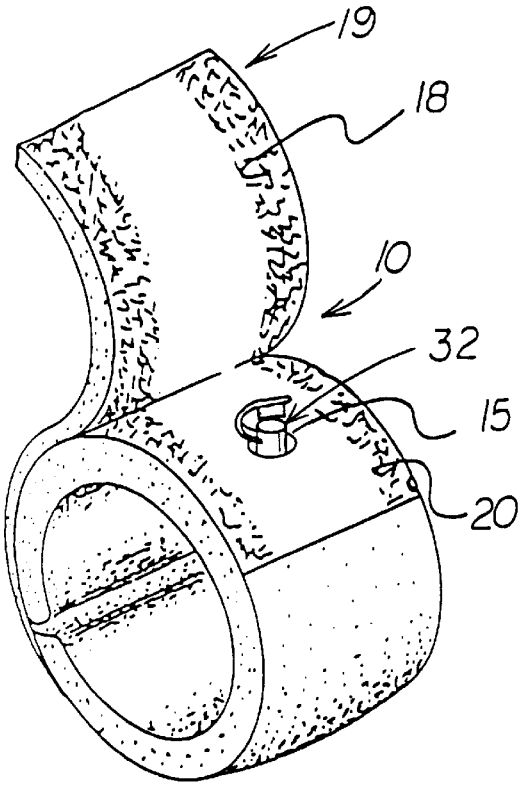
FIG. 16 is a perspective view showing a preferred embodiment of the wrist-carried water container apparatus wherein the collapsible spigot having a stopper removed extends outwardly past the jacket wall exposed by detaching a portion of the hook and loop fastener retained strap of material.
Figure 17:
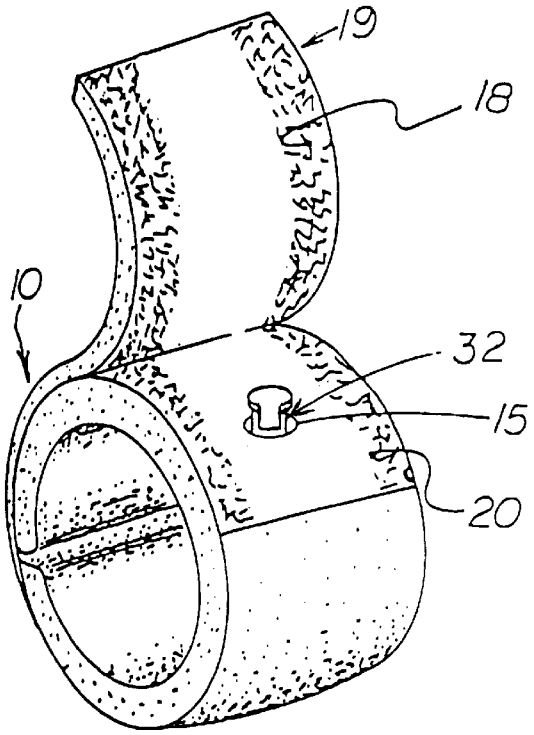
FIG. 17 is a perspective view showing a preferred embodiment of the wrist-carried water container apparatus wherein the collapsible spigot having a stopper is collapsed to fit within the opening formed in the jacket and a strip of material covers the spigot.
Figure 18:
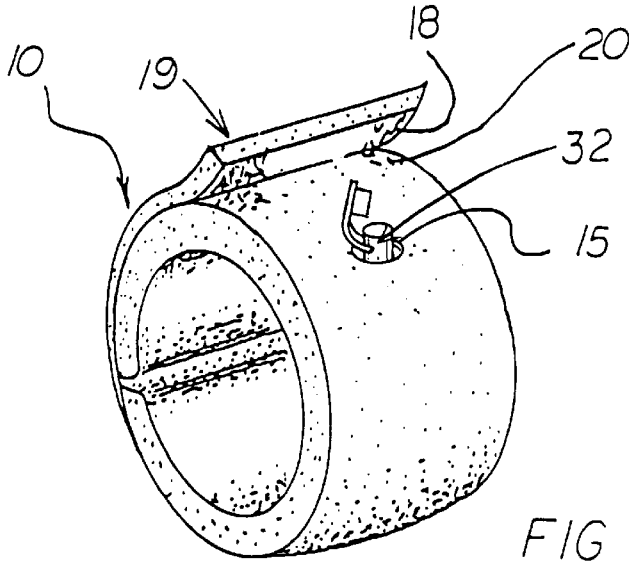
FIG. 18 is a perspective view showing a preferred embodiment of the wrist-carried water container apparatus wherein the collapsible spigot having a stopper is collapsed to fit within the opening formed in the jacket and the stopper of the spigot is exposed.

FIGS. 7–10 show embodiments wherein straps having hook and loop fasteners are removably engagable with the hook and loop fastener elements 20. FIG. 11 shows an embodiment wherein a separate flap 30 secures the tube 26 in position before covering with the strap.

Preferably, the flexible jacket assembly 12 and the flexible liquid-tight container assembly 22 are dimensioned to fit around a wearer's wrist such that a wristband liquid container apparatus 10 is provided. Alternatively, the flexible jacket assembly 12 and the flexible liquid-tight container assembly 22 are dimensioned to fit around a wearer's head such that a headband liquid container apparatus 10 is provided.

The first fastener element 18 and the second fastener element 20 are made from complementary hook-and-loop material, such as well-known VELCRO (™) material.

To retain the wrist-carried liquid container apparatus 10 on a person's wrist, as shown in FIG. 1, the flexible jacket assembly 12 is wrapped around the person's wrist, the flexible spout tube 26 is bent against the second fastener element 20, and the first fastener element 18 is attached to the second fastener element 20. With the flexible spout tube 26 bent against the second fastener element 20 and with the first fastener element 18 attached to the second fastener element 20, there is a crimp 17 in the flexible spout tube 26, and the crimp 17 serves as a shut-off valve for the flexible spout tube 26. The tube may also be formed having a distal spout end having a small opening or slit and/or may utilize a cap or plug instead of or in combination with the crimp 17 to prevent flow of the liquid during storage.

The dimensions of the first fastener element 18 and the second fastener element 20 are provided such that a wide range of amounts of attachment overlap can accommodate a wide range of wrist sizes. For larger wrist circumferences, a smaller amount of fastener overlap would occur. For smaller wrist circumferences, a larger amount of fastener overlap would occur.

Figure 4:
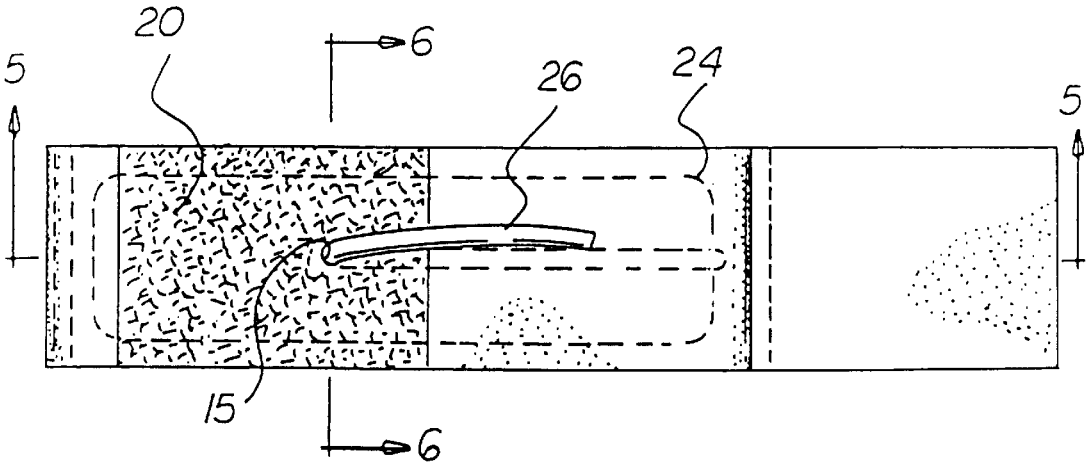
FIG. 4 is a top view of the embodiment of the invention shown in FIG. 3 after having been unfastened and laid out flat.
Figure 7:
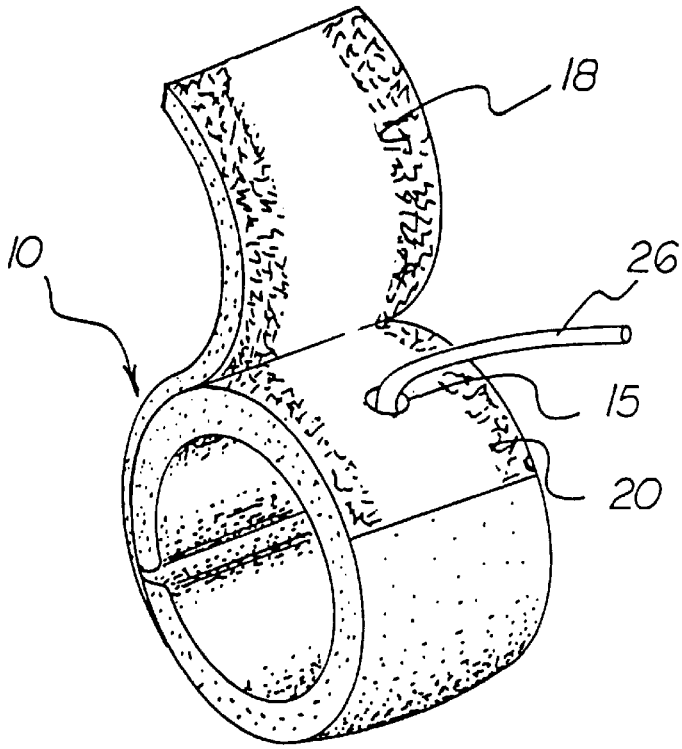
FIG. 7 is a perspective view of the embodiment of the wrist carried water container apparatus of FIG. 2 in the process of being unfastened from a wrist encompassing status showing a pair of hook and loop fastening straps extending on each side or straddling said tube.
Figure 8:
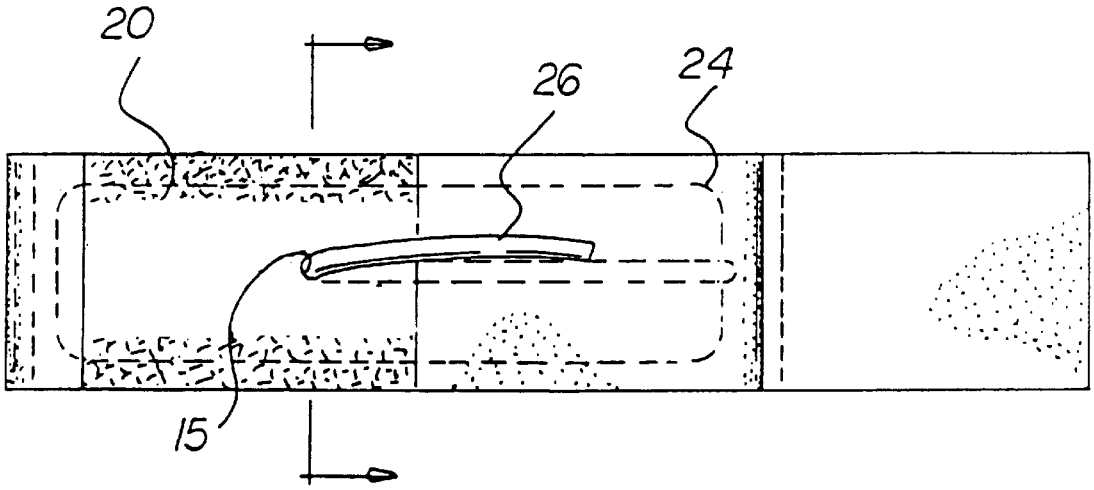
FIG. 8 is a top view of the embodiment of the invention shown in FIG. 7 after having been unfastened and laid out flat wherein the tube is kinked to impede the flow of fluid by securing the holding flap with hook and loop fastener straps on each side thereof.
Figure 9:
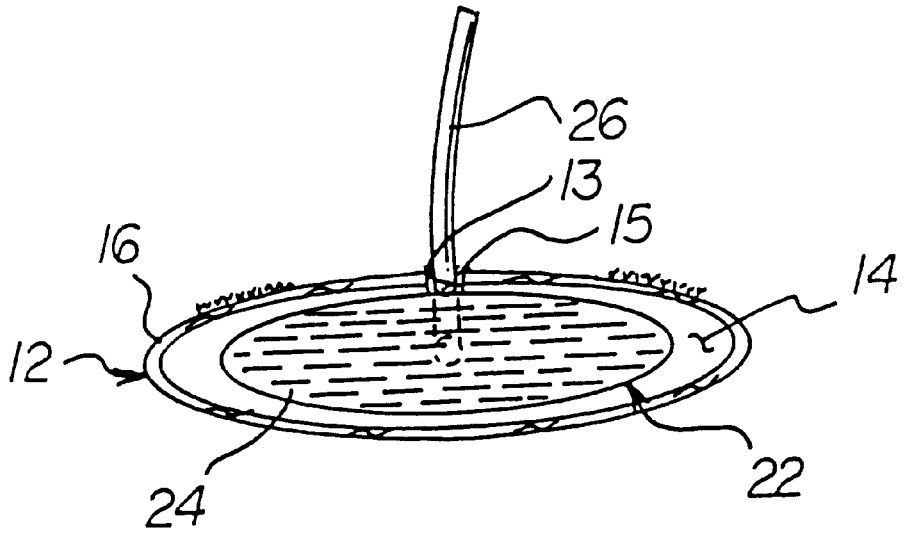
FIG. 9 is a cross-sectional view of the embodiment of the invention shown in FIG. 7 taken along line 9—9 of FIG. 8.
Figure 10:
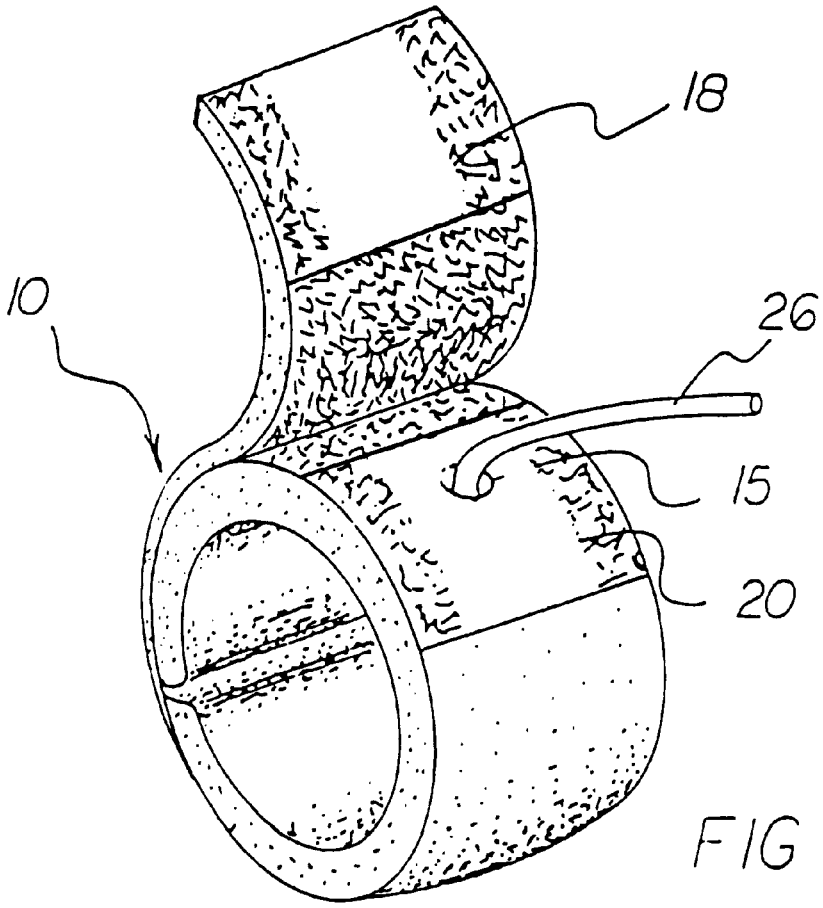
FIG. 10 is a perspective view of an embodiment of the wrist carried water container apparatus in the process of being unfastened from a wrist encompassing status showing a pair of hook and loop fastening straps extending from the distal end of the wrist strap on each side or straddling said tube.

When the first fastener element 18 is detached from the second fastener element 20 a sufficient amount to allow the flexible spout tube 26 to be lifted and uncrimped, the person can suck on the flexible spout tube 26 like a straw to obtain liquid from the flexible container portion 24. With the first fastener element 18 completely detached from the second fastener element 20, the wrist-carried liquid container apparatus 10 can be completely removed from the person's wrist and laid flat, such as shown in FIGS. 4 and 5. The flexible container portion 25 can be filled through the flexible tube spout 26 or through a separate fill hole (not shown) in the flexible container portion 24. Disposable bags filled with liquid, ice, or other semisolid fluid may be used as well.

The embodiment shown in FIGS. 12–18 utilize a collapsible spigot 32 attached to the tube 26 of the flexible container 22. A typical spigot 32 arrangement as shown best in FIGS. 12–13 has a cylindrical base portion 34 connected to a neck 36 of smaller diameter extending upward therefrom wherein the neck 36 can be pushed downward into the cylindrical base portion 34. The spigot 32 includes a stopper 38 defining a plunger 40 extending from a cover flap 42 optionally connected to the base 34 or neck 36 by strap 37. The plunger 40 of the stopper 38 is formed being smaller or larger than the neck 36 of the spigot for cooperatively engages the distal end of spigot neck 36. In the collapsed state the spigot 32 can be nested in the opening 15 of the exterior jacket 12 or optionally be covered with a strip of material such as the cover flap 19. The spigot 32 is comprised of soft pliable plastic and preferably the plunger 34 is integrally molded or attached to the spigot body tube 26.

The flexible jacket assembly 12 can be made from heat insulating material, such as a cloth material. The volumetric capacity of the flexible container portion 24 can be any suitable volume. More specifically, a relatively small amount of water, for example 4 to 6 ounces, can be stored in the flexible container portion 24 to fend off dehydration for a runner or other person participating in an athletic activity. In this respect, the wrist-carried water container apparatus 10 of the invention is lightweight, comfortable, and will not hinder movement, slosh, or create excessive bulk.

The components of the wrist-carried water container apparatus of the invention can be made from inexpensive and durable metal and plastic materials.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A personal storage and liquid dispensing device, comprising:

a flexible band comprising a jacket having a first end and a second end including an inner and outer layer of material joined together at the sides and on at least one end forming a container retention space thereinbetween;

said flexible band including a removable flexible container for holding liquid within said container retention space;

said flexible container including a tube connecting thereto for removing the liquid therefrom;

means for stopping the flow of water flowing from said flexible reservoir through said tube;

said flexible band including an opening for extending said tube therethrough;

said first end of said jacket including means for releasably holding attaching to an exterior surface thereof cooperatively engaging with said second end of said jacket including means for releasably holding attaching to an interior surface thereof; and said personal storage and liquid dispensing device removably circumscribing a selected limb of an individual wearer and being securely held on said selected limb during use.

2. The personal storage and liquid dispensing device of claim 1, wherein said limb is selected from the group consisting of an arm, a wrist, an ankle, or a leg.

3. The personal storage and liquid dispensing device of personal storage and liquid dispensing device of claim 2, including a removable flap covering said portion of said tube extending.

4. The personal storage and liquid dispensing device of personal storage and liquid dispensing device of claim 1, said container retention space including at least two compartments.

5. The personal storage and liquid dispensing device of claim 4, said at least two compartments including at least two flexible containers.

6. The personal storage and liquid dispensing device of claim 1, wherein said means for stopping the flow of water flowing from said flexible reservoir through said tube comprises a collapsible spigot attaching to said tube of said flexible container.

7. The personal storage and liquid dispensing device of claim 6, wherein said spigot comprises a cylindrical base portion connecting to a neck of smaller diameter extending upward therefrom wherein said neck can be pushed downward into a cylindrical base portion.

8. The personal storage and liquid dispensing device of claim 7, said spigot including a stopper defining a plunger extending from a cover flap connecting to said neck by a strap.

* * * * *